US010526132B2

(12) United States Patent
Schroer et al.

(10) Patent No.: US 10,526,132 B2
(45) Date of Patent: Jan. 7, 2020

(54) DISPENSER FOR CAN WITH FIXED VALVE STEM HOUSING

(71) Applicant: DOW GLOBAL TECHNOLOGIES LLC, Midland, MI (US)

(72) Inventors: Daniel R. Schroer, Midland, MI (US); Marc S. Black, Midland, MI (US); Chad V. Schuette, Midland, MI (US); Christopher J. Siler, Midland, MI (US); Daniel Ramirez, Midland, MI (US)

( * ) Notice: Subject to any disclaimer, the term of this patent is extended or adjusted under 35 U.S.C. 154(b) by 0 days.

(21) Appl. No.: 16/379,840

(22) Filed: Apr. 10, 2019

(65) Prior Publication Data

US 2019/0308798 A1 Oct. 10, 2019

Related U.S. Application Data

(60) Provisional application No. 62/655,284, filed on Apr. 10, 2018.

(51) Int. Cl.
*B65D 83/48* (2006.01)
*B65D 83/20* (2006.01)
(Continued)

(52) U.S. Cl.
CPC ..... *B65D 83/201* (2013.01); *B65D 83/206* (2013.01); *B65D 83/30* (2013.01);
(Continued)

(58) Field of Classification Search
CPC ..... B65D 83/48; B65D 83/30; B65D 83/206; B65D 83/303
See application file for complete search history.

(56) References Cited

U.S. PATENT DOCUMENTS 3,506,241 A 4/1970 Ewald
4,436,229 A 3/1984 Beard
(Continued)

FOREIGN PATENT DOCUMENTS

DE 2128080 A1 12/1972
DE 102007041986 A1 3/2009
(Continued)

OTHER PUBLICATIONS

C. Ehrensperger AG, Ehrensperger Pageris dispenser, http://www.ehrensperger-ag.ch/en/products/aerosol-technology/dispenser/.
(Continued)

*Primary Examiner* — David P Angwin
*Assistant Examiner* — Bob Zadeh
(74) *Attorney, Agent, or Firm* — Andrew G. Bunn

(57) ABSTRACT

An article with a can and a dispenser, the can having a valve with a valve cup, valve stem housing and depressible valve stem and the dispenser having a base, a straw attached to the base, a sleeve extending over at least a portion of the straw, a trigger hingedly attached to the base and/or straw at a hinge point with a trigger section that engages the sleeve above the hinge point and a trigger arm that extends below the hinge point, and a plunger extending through a side of the base and into a flow channel of the dispenser while maintaining fluid communication through and/or around the plunger within the flow channel of the dispenser where the dispenser is attachable to the can by inserting the stationary valve stem housing into the flow channel of the dispenser base while inserting the dispenser base into the valve cup.

6 Claims, 3 Drawing Sheets

(51) Int. Cl.
*B65D 83/30* (2006.01)
*B05B 11/00* (2006.01)

(52) U.S. Cl.
CPC ..... *B05B 11/3053* (2013.01); *B65D 83/303* (2013.01); *B65D 83/48* (2013.01)

(56) References Cited

U.S. PATENT DOCUMENTS 4,856,684 A 8/1989 Gerstung
5,154,323 A * 10/1992 Query ..... B65D 83/205 222/153.11
5,549,226 A * 8/1996 Kopp ..... B65D 83/303 222/402.13
5,887,756 A * 3/1999 Brown ..... B05B 1/3046 222/136
10,364,092 B2 * 7/2019 Schroer ..... B65D 83/345
2002/0000454 A1 * 1/2002 Stern ..... B05B 1/02 222/402.1
2006/0243754 A1 11/2006 Rackwitz
2007/0090133 A1 * 4/2007 Macleod ..... B65D 83/206 222/402.13
2009/0039114 A1 * 2/2009 Yamamoto ..... B65D 83/205 222/402.14
2012/0097180 A1 * 4/2012 Harris ..... B65D 83/206 132/200
2012/0204379 A1 * 8/2012 Isenhour ..... B65D 83/28 15/405
2013/0320044 A1 * 12/2013 Hoagland ..... B05B 1/3046 222/402.1
2013/0320045 A1 12/2013 Hoagland et al.
2014/0224828 A1 * 8/2014 Demey ..... B05B 1/3073 222/23
2014/0263741 A1 * 9/2014 Deutsch ..... B05B 14/00 239/337
2016/0223097 A1 * 8/2016 Demey ..... B65D 83/303
2018/0354708 A1 * 12/2018 Schroer ..... B65D 83/201

FOREIGN PATENT DOCUMENTS

WO 2017139128 A1 8/2017
WO 2017139131 A1 8/2017

OTHER PUBLICATIONS

International Search Report dated Jul. 22, 2019 for corresponding International Application No. PCT/US19/26694, filed on Apr. 10, 2019.

* cited by examiner

DISPENSER FOR CAN WITH FIXED VALVE STEM HOUSING

BACKGROUND OF THE INVENTION

Field of the Invention

Introduction

Dispensing fluid, particularly foamable fluid, from a compressed can is useful for many products including whipped dairy toppings and spray foam for sealing and thermal insulation applications. Foamable fluid is often available as foamable liquid under pressure in a can that is dispensed through an application tube attached to a valve or valve stem on the can. Upon release from the pressurized can the foamable liquid expands into foam.

Many types of compressed cans of fluid comprise a valve that can be opened by tilting the valve stem of the valve assembly. Examples of such valves are taught in U.S. Pat. Nos. 3,506,241, 4,436,229, and 4,856,684. Dispensers for opening such valves by attaching to the actual valve stem and tilting the valve stem are the subject of numerous dispenser technologies including those disclosed in US2013/0320045, WO2017/139128 and WO2017/139131.

Dispensers designed to tilt a valve stem to dispense fluid are not suitable for use on cans that comprise a valve without a tilting valve stem assembly. For example, C. Ehrensperger AG offer PAGERIS™ valves for cans that have a valve cup around a stationary valve stem housing in which a depressible valve stem resides and that extends out from or is accessible through only the top of the valve stem housing. Such a valve assembly shall generically be called herein a "Pageris-type" valve. The stationary valve stem housing prevents tilting of the valve stem to open the Pageris-type valve and requires depressing the valve stem through the top of the stationary valve stem housing to open the Pageris-type valve. Pageris-type valves have a place in the industry that necessitates providing a dispenser for them that can readily be actuated by a single hand that is holding the can. Additionally, it is desirable if the dispenser seals the dispensing device when closed so as to preclude expansion and/or dripping of fluid when a user is not intending to dispense fluid. Moreover, it is desirable if the dispenser can simultaneously open the Pageris-type valve of a can and unseal with a single actuating motion and simultaneously close the Pageris-type valve of a can and seal the dispenser to preclude dripping with a single actuating motion.

BRIEF SUMMARY OF THE INVENTION

The present invention provides a dispenser that can open a can of compressed fluid having a Pageris-type valve by actuating with a single hand. Moreover, the dispenser of the present invention can seal to prevent dripping when not actuated to dispense fluid. Even more, in some embodiments, the dispenser can simultaneously open the Pageris-type valve of a can and unseal a dispenser with a single actuating motion and simultaneously close the Pageris-type valve of a can and seal the dispenser to preclude dripping with a single actuating motion.

The present invention is a result of discovering how to attach to a Pageris-type valve while enabling simultaneous and reversible sliding of a sleeve over the dispenser to unseal it while pressing a plunger against the valve stem of the can to open it. The dispenser attaches to the stationary valve stem housing and utilizes a plunger to depress the valve stem to open the valve.

In a first aspect, the present invention is an article (10) comprising a can (20) and a dispenser (30), wherein: (a) the can has a valve (40) that includes a valve cup (42) surrounding a stationary valve stem housing (44) in which a depressible valve stem (46) resides and which extends out from or is accessible through a top side (48) of the stationary valve stem housing; and (b) the dispenser comprises: (i) a base (50) that has a side (52), a bottom (54) and a top (55) with an entrance opening (56) to a flow channel (58) defined through the bottom and extending through the base and out the top, wherein the base fits into the valve cup of the can with the stationary valve stem housing inserted into the entrance opening of the base when attached to the valve of the can; (ii) a straw (60) having a straw wall (62) separating opposing entrance (64) and exit (66) ends by a length (L) where the straw wall defines a straw flow channel (68) that extends from an entrance opening (65) defined through the straw proximate to the entrance end through an exit opening (67) defined through the straw proximate to the exit end and where the straw is attached proximate to its entrance end to the base proximate to the top of the base such that there is fluid communication from the flow channel of the base through the entrance opening and into the flow channel of the straw where the base flow channel and the straw flow channel form a continuous dispenser flow channel extending through the entrance opening of the base through the dispenser and out through the exit opening of the straw; (iii) a sleeve (70) extending over at least a portion of the length of the straw and that is able to slide over the straw along at least a portion of the length of the straw, the sleeve having an exit opening (72) extending through the sleeve proximate to the exit end of the straw; (iv) a trigger (80) hingedly attached to the base and/or straw of the dispenser at a hinge point (82) so that the trigger can move without moving the straw or base and having a sleeve engagement portion (84) of the trigger that engages the sleeve above the hinge point and a trigger arm (86) extending below the hinge point; and (v) a plunger (90) extending from the trigger arm of the trigger, through a side of the base and into the flow channel of the base while maintaining a fluid communication through and/or around the plunger within the flow channel of the dispenser; wherein, the dispenser is attachable to the valve of the can by inserting the stationary valve stem housing into the entrance opening of the flow channel of the dispenser base while inserting the dispenser base into the valve cup of the valve; and wherein, the plunger extends into the dispenser flow channel far enough so that when the dispenser is attached to the valve of the can the depressible valve stem is in a closed position that seals the can valve while the trigger arm is in a closed position, and displacing the trigger arm from the closed position to an open position causes the sleeve to slide along the straw away from the entrance opening of the straw and causes the plunger to depress the depressible valve stem into an open position.

The present invention is useful for dispensing fluid from a can of compressed fluid that has a Pageris-type valve.

DETAILED DESCRIPTION OF THE INVENTION

"And/or" means "and, or alternatively". All ranges include endpoints unless otherwise stated. "Multiple" means more than one. "Fluid" refers to a substance that has no fixed shape and yields to external pressure. Fluid includes gas, liquid, and gas or liquid continuous formulations. Typically, though not necessarily, fluid refers to liquid and liquid continuous formulations as used herein.

Unless otherwise indicated in the context of its usage herein, orientation references are in reference to the direction of fluid flow from the can of the article through the dispenser flow channel as described in this paragraph. Terms referring to an elevated position of an element such as "top" or "above" refer to the portion of the element furthest along the direction of fluid flow. Terms referring to an elevating direction such as "up" refers to the direction of fluid flow. Terms referring to a subordinate position of an element such as "bottom" or "below" refer to the portion of the element least furthest along the direction of fluid flow. Terms referring to a subordinate direction such as "down" refer to the opposite direction of fluid flow.

The following description makes reference to FIGS. 1-4 to facilitate understanding. However, for avoidance of any doubt, the FIGS. 1-4 do not illustrate the full breadth of the invention but only embodiments of the elements of the invention to illustrate how they can fit together or be manifest. For avoidance of doubt, the broadest scope of the invention is intended to allow for embodiments of components as taught herein to be combined in any way physically allowable within the scope of the teaching and not be specifically limited to that illustrated in FIGS. 1-4. However, FIGS. 1-4 do illustrate embodiments of the invention.

The following description generally identifies the element number from the Figures only with the first mention of the element for the sake of easier reading.

Figure 1A:
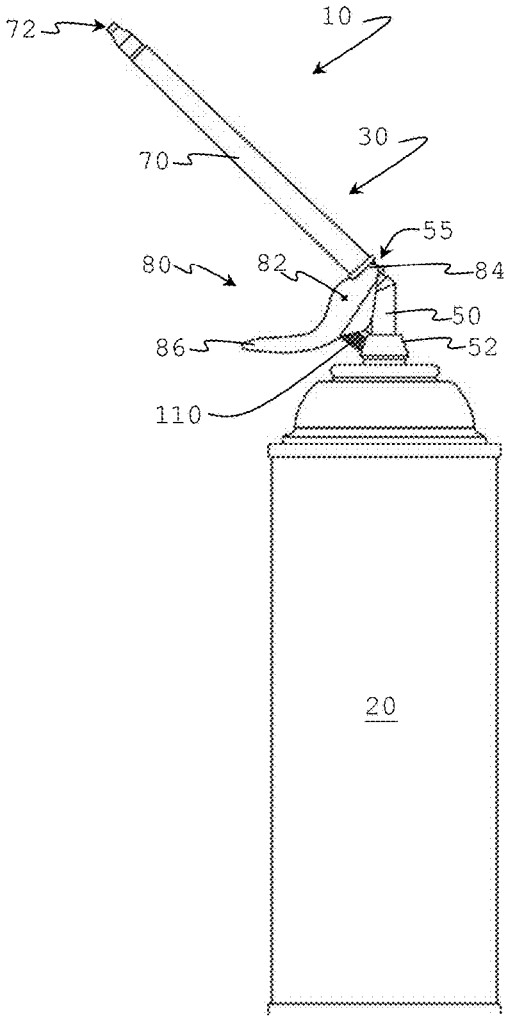
FIG. 1A illustrates a side view of an article of the present invention.
Figure 1B:
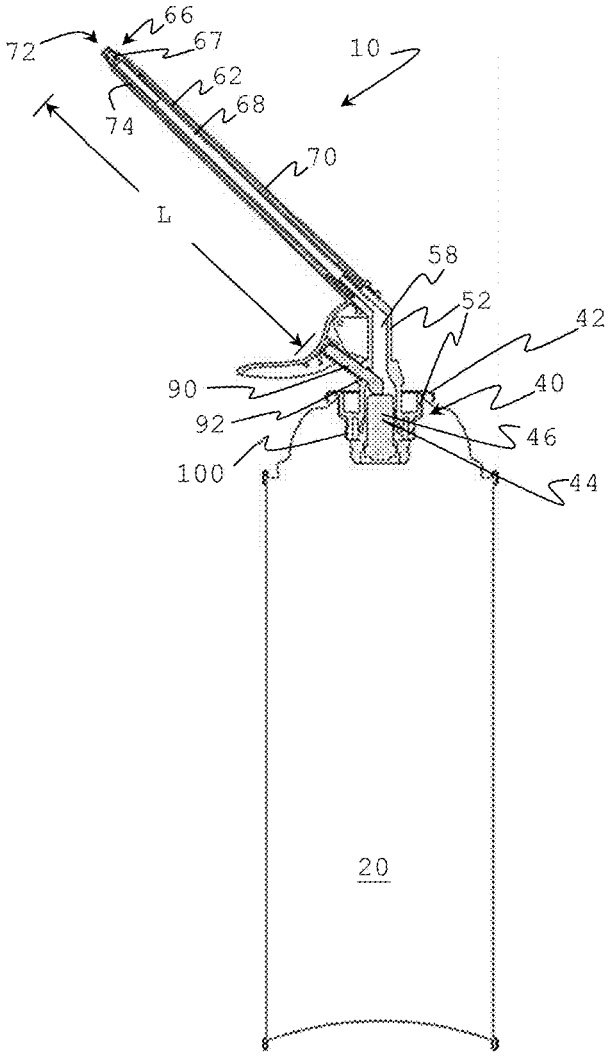
FIG. 1B illustrates a cut-away side view of the article of FIG. 1A.

The present invention is an article (10) comprising a can (20) and a dispenser (30). FIGS. 1A and 1B illustrate a side view and a cut-away side view of one type of article of the present invention, respectively. The article is useful for dispensing compressed fluid from the can through the dispenser. For example, the article may include a can containing a liquid such as dairy product, polyurethane foam formulation or latex foam formulation.

Figure 2:
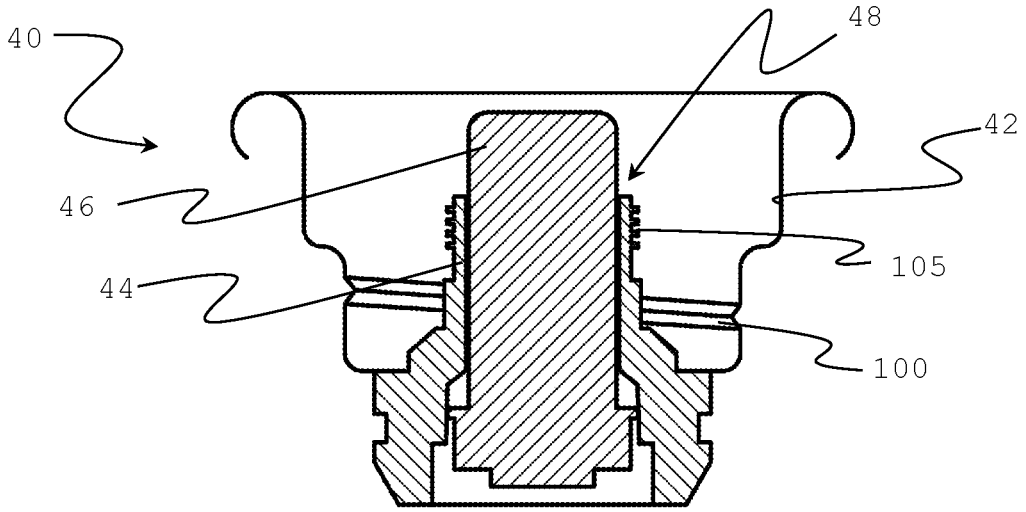
FIG. 2 illustrates a cut-away side view of a Pageris-type valve.

The can has a valve (40). Pressurized fluid in the can dispenses through the valve. The valve is a "Pageris-type" valve, which means it includes a valve cup (42) surrounding a stationary valve stem housing (44) in which a depressible valve stem (46) resides. FIG. 2 illustrates a cut-away side view of an example of a Pageris-type valve of the present invention. The stationary valve stem housing has a top side (48). The depressible valve stem extends out from the top side of the stationary valve stem housing or is accessible within the valve stem housing through the top side of the valve stem housing. The stationary valve stem housing is typically a cylindrical structure. The stationary valve stem housing is rigidly attached to the valve cup so that it cannot tip, bend or compress relative to the valve cup. It serves the purpose of protecting the valve stem from accidentally being depressed. Depressing the valve stem (that is, displacing the valve stem towards the can within the valve stem housing) opens the valve and provides fluid communication from inside the can to outside the can, releasing pressurized fluid that is within the can. When the valve stem is depressed so as to open the valve then the valve and valve stem are in an "open position", otherwise they are in a "closed position". When the valve stem is in the closed position the can is sealed shut. Typically, the pressure from the can, or an elastic element (such as a spring) between the valve cup and valve stem keeps the valve stem in a closed position until actively depressed to the open position.

Figure 3:
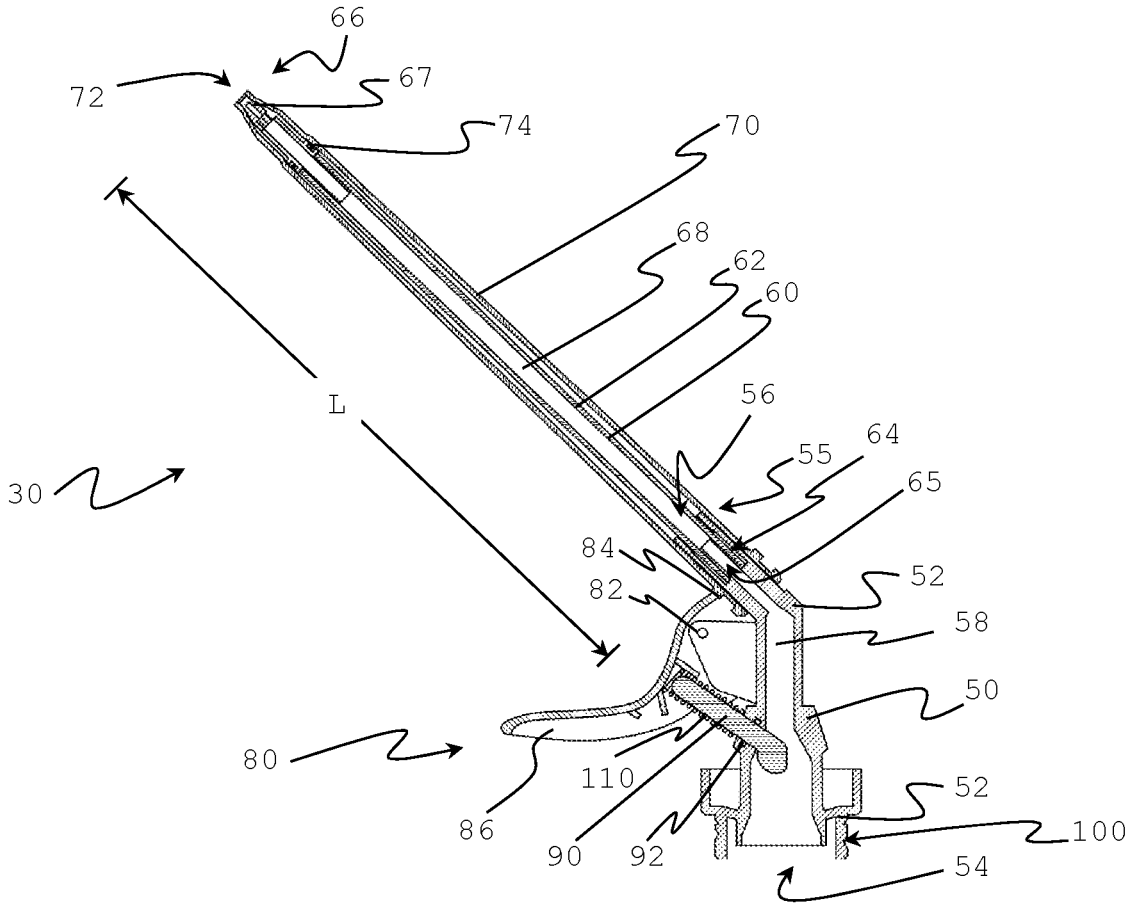
FIG. 3 illustrates a cut-away side view of a dispenser of the present invention.

The dispenser comprises a base (50), a straw (60), a sleeve (70), a trigger (80) and a plunger (90). FIG. 3 illustrates a cut-away side view of one form of dispenser within the scope of the present invention.

Figure 4A:
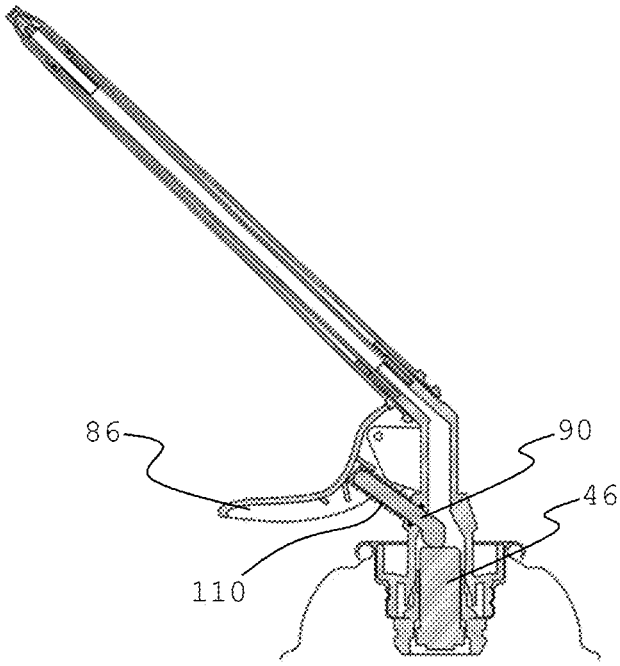
FIG. 4A illustrates a cut-away side view of the article of the present invention with the dispenser in a closed position.
Figure 4B:
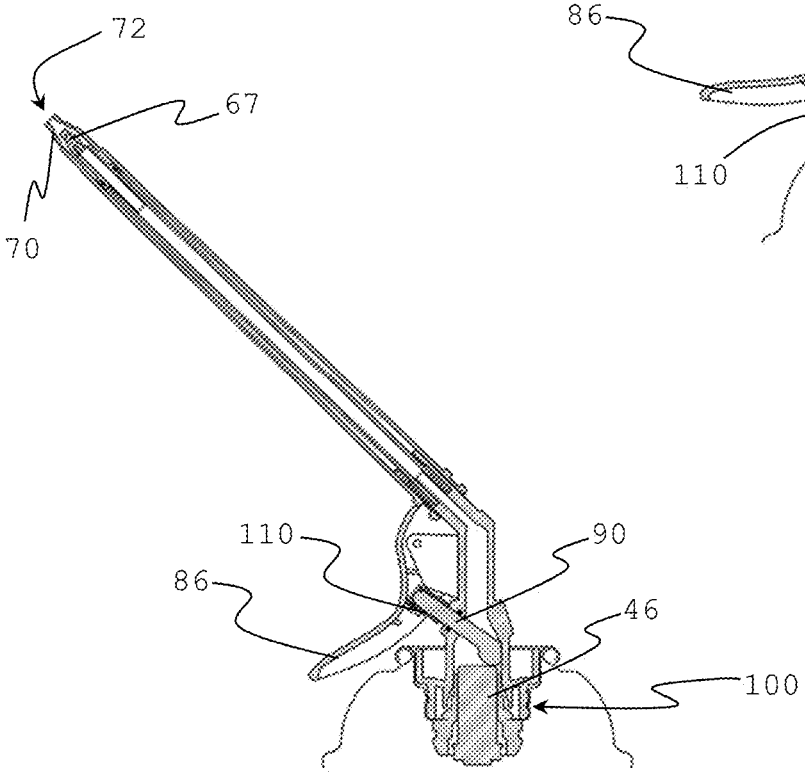
FIG. 4B illustrates a cut-away side view of the article of the present invention with the dispenser in an open position

The base (50) of the dispenser has a side (52), a bottom (54) and a top (55). The base defines an entrance opening (54) through the bottom and into a flow channel (58). The flow channel is defined and provides fluid communication all the way through the base within the side extending through bottom and top of the base. When the dispenser is attached to the valve of the can, the base fits into the valve cup of the valve with the stationary valve stem inserted into the entrance opening of the base. The base of the dispenser desirably is free of any portion that fastens to the valve cup by extending over the top of the valve cup, for example clipping onto the valve cup over the top of the valve cup. FIGS. 4A and 4B illustrate a dispenser having a base that is fit within the valve cup and that is free of any portion that fastens to the valve cup by extending over the top of the valve cup.

The dispenser can screw onto the valve in order to facilitate attachment to the valve and can. That is, the dispenser and valve can engage with one another with threading that mates in a threaded manner. For example, the outside of the base wall and the inside of the valve cup can have threading (100) that mate in a threaded manner. Alternatively, or additionally, the inside of flow channel of the base proximate to the entrance opening and the outside of the stationary valve stem housing can have threading (105) that mate in a threaded manner. The "outside of the base wall" or the "outer surface of the base wall" refers to the portion of the base wall most proximate to the valve cup and opposite that portion of the base wall most proximate to the base flow channel. The "inside of the valve cup" or the "inner surface of the valve cup" refers to the portion of the valve cup within the cupped domain defined by the valve cup and the portion of the valve cup that is most proximate to the dispenser base wall. The "outside of the stationary valve stem housing" or the outer surface of the stationary valve stem housing" refers to the portion of the valve stem housing on the outer surface of the tubular configuration of the valve stem housing, the surface of the valve stem housing opposing the valve stem. Similarly, the "inside of the entrance opening and/or flow channel of the base" refers to the "inner surface of the entrance opening and/or flow channel of the base".

The straw (60) of the dispenser has a straw wall (62) separating an entrance end (64) and an exit end (66) on opposing ends of the straw and separated by a length (L) of the straw. The straw wall defines a straw flow channel (68) that extends from an entrance opening (65) defined through the straw proximate to the entrance end, through the length of the straw and through an exit opening (67) defined through the straw proximate to the exit end. The straw can have one or multiple exit openings defined through the straw proximate to the exit end. The straw is attached proximate to its entrance end (preferably at its entrance end) to the base proximate to the top of the base (preferably at the top of the base) such that there is fluid communication from the flow channel of the base through the entrance opening and into the flow channel of the straw. The straw can attach to the base by fitting over a portion of the wall of the base surrounding the flow channel through the base; that is, by inserting a portion of the wall around the blow channel of the base that includes the top of the base into the flow channel of the straw through the entrance end of the straw. The flow channel through the base and the straw flow channel form a dispenser flow channel that extends continuously through dispenser from the entrance opening in the base through the exit opening of the straw.

The sleeve (70) extends over at least a portion of the straw along the straw's length. The sleeve can extend over the exit end of the straw as well as along at least a portion of the straw's length. Alternatively, the sleeve can be free of a portion that extends over the exit end of the straw. The sleeve has an exit opening (72) extending through the sleeve proximate to the exit end of the straw. When fluid is dispensed through the dispenser it travel through the flow channel of the dispenser and out from the exit opening of the straw and through the exit opening in the sleeve. Desirably, there is a gasket (74) extending circumferentially around the straw between the entrance opening and exit opening of the straw (preferably, proximate to the exit opening) and between the sleeve and the straw that contacts both the sleeve and straw wall so as to form a seal between the two around the straw. Such a gasket serves to preclude fluid from flowing between the straw and sleeve. Suitable gaskets include an O-ring. The gasket can reside in a groove in the straw wall, the sleeve, both the sleeve and straw wall or just reside freely without residing in any groove.

The sleeve is able to slide over the straw along the straw's length. Desirably, the sleeve slides along the straw between a "closed position" and an "open position". When the sleeve is in a "closed position" it seals all exit openings of the straw, preventing fluid flow from the dispenser flow channel through any exit opening in the straw. When the sleeve is in an "open position" the sleeve is free from at least one exit opening of the straw meaning fluid is free to flow from the flow channel through the straw through the exit opening of the straw. Desirably, sliding the sleeve towards the exit end of the straw when the sleeve is in a closed position moves the sleeve into an open position. Similarly, sliding the sleeve towards the entrance end of the straw when the sleeve is in an open position will move the sleeve into a closed position.

When the sleeve is in a closed position the sleeve seals the exit opening of the straw. This precludes dripping of fluid from the dispenser when closed. In the broadest scope of the invention, the means of sealing the exit end of the straw is without limit. For example, the sleeve can press against the straw wall around and extend over the exit opening thereby blocking fluid communication from the straw flow channel through the exit opening of the straw. Examples of such a means of the sleeve sealing the exit opening of the straw are taught in WO2017/139128. For example, the straw can have a tapered exit end with one or multiple exit openings and the sleeve can have a tapered exit end that conforms to the taper on the straw and presses against the straw when in the closed position so as to seal the exit opening(s) of the straw. The sleeve can additionally or alternatively comprise a protrusion that extends at least partially into the exit opening of the straw to seal the exit opening when in the closed position. Examples of such means by which the sleeve seals the exit opening of the straw when in the closed position are taught in WO2017/139131. For example, the exit opening of the straw can be through the exit end of the straw and the sleeve can define a protrusion that extends into the exit opening of the straw when in the closed position. The sleeve desirably has one or more than one exit opening around the protrusion to allow fluid to flow out from between the straw and sleeve when in the open position. As another example, the straw can have one or more than one exit opening through the straw wall proximate to but not on the exit end of the straw and the sleeve can have a protrusion for each exit opening of the straw that fits into each exit opening to seal them when the sleeve is in the closed position. In such an embodiment, the sleeve can either extend over the exit end of the straw and have exit opening(s) through its wall or be free of any portion of sleeve that extends over the exit end of the straw and essentially have an exit opening over the exit end of the straw.

The trigger (80) hingedly attaches to the base and/or straw of the dispenser at a hinge point (82) in such a way that the trigger can move without moving the straw or base. For example, the base and/or straw can have a protrusion around which a portion of the trigger extends and a pin can extend through the protrusion and portion of the trigger to establish a hinged attachment. Alternatively, the trigger can attach to the base and/or straw by means of a flexible material or an article comprising a flexible or compressible element that allows for hinged bending of the trigger with respect to the straw.

The trigger has a sleeve engagement portion (84) that engages the sleeve above the hinge point. That is, the location where the sleeve engagement portion engages the sleeve is closer to the exit opening of the sleeve than where the trigger hingedly attaches to the base and/or straw. The sleeve engagement portion can engage the sleeve in any manner that allows movement of the sleeve engagement portion relative to the straw to cause the sleeve to move along the length of the straw. For example, the sleeve engagement portion can engage the sleeve by extending protrusions on either side of the sleeve within a groove defined on the sleeve. Alternatively, the sleeve engagement portion can define an eyelet that extends circumferentially around the sleeve and that resides at least partially within a groove of the sleeve and/or between protrusions in the sleeve. In the broadest scope of the invention, the means by which the sleeve engagement portion engages the sleeve is unlimited provided that it allows displacement of the sleeve engagement portion relative to the straw to induce the sleeve to slide along the length of the straw.

The trigger has a trigger arm (86) that extends below the hinge point. That is, the trigger arm extends from the hinge point in a direction generally opposite from the sleeve engagement portion so that moving the trigger arm in the general direction of the dispenser base causes the trigger to hinge at the hinge point and displace the sleeve engagement portion towards the exit end of the straw. The trigger arm is generally long enough to allow a user's finger to be placed on it and to apply pressure to the trigger arm in order to actuate the sleeve to an open position from a closed position. The trigger and trigger arm are in a "closed" position when located so as to allow the sleeve to be in a closed position. The trigger and trigger arm are in an "open" position when they are located in a position that causes the sleeve to be in an open position. Depressing the trigger arm generally towards the can while in the closed position typically displaces the trigger arm and sleeve into their open positions.

Desirably, there is an elastic element (110) located between the trigger arm and base and/or straw that establishes a force on the trigger arm directing the trigger arm to a closed position while in the open position. For example, the elastic element can be a spring that is compressed when a force is applied to the trigger that moves it from its closed position to its open position, and a restorative force of the spring applies a force to restore the trigger to its closed position when the applied force is removed.

The plunger (90) extends from the trigger arm through the side of the base and into the flow channel of the base. While the plunger extends into the flow channel of the base, there remains fluid communication through and/or around the plunger within the flow channel of the base and within the flow channel of the dispenser as a whole. That is, the plunger does not seal off fluid communication through the flow channel of the dispenser. The plunger can have a size that allows fluid communication around it within the flow channel. Alternatively, or additionally, the plunger can have one or more than one opening defined therethrough that establishes fluid communication through the plunger within the flow channel.

The plunger is free to move through the wall of the base wall as opposed to being rigidly attached to the wall of the base. Desirably, there is a gasket (92) between the plunger and wall of the base to form a fluid-tight seal between the plunger and wall to preclude leaking of fluid from the flow channel of the base through the wall around the plunger. An example of a suitable gasket is an O-ring that extends around the plunger. The gasket can reside in a groove in the wall of the base and/or in a groove around the plunger to hold the gasket in place.

The plunger extends from the trigger arm, which means it extends from a point close enough to the trigger arm that, upon actuating the trigger arm so as to slide the sleeve to an open position, also causes the trigger arm to depress the plunger into the base of the dispenser. The plunger can be attached to the trigger arm or be unattached to the trigger arm. The plunger extends into the flow channel of the base far enough that when the dispenser is attached to the valve of the can, the valve stem of the can remains in its closed position when the trigger is in its closed position but the trigger causes the plunger to depress the valve stem and open the valve of the can when the trigger is in its open position. When the trigger is returned to its closed position the plunger can move away from the valve stem sufficiently far so as to allow the valve stem to move to its closed position.

See, for example, FIGS. 4A and 4B. FIG. 4A shows an article of the present invention where the trigger is in its closed position with the plunger extending into the flow channel of the dispenser but not depressing the valve stem so as to cause it to open the valve. Notably, the sleeve is also in a closed position. FIG. 4B show the trigger in its open position with the plunger extending into the flow channel of the dispenser and depressing the valve stem so as to cause it to open the valve, and with the sleeve displaced along the straw to its open position. When in the open position as shown in FIG. 4B, elastic element (110) applies a restorative force directing the trigger to its closed position as illustrated in FIG. 4A.

The trigger simultaneously activates both the sleeve and the valve stem by moving them both from a closed position to an open position, or from an open position to a closed position with a single action. Hence, the dispenser serves as a "single action" dispenser for a Pageris-type valve. A benefit of simultaneously activating the sleeve with the can valve is that the dispenser can seal the straw from dripping when closing the valve to the can, and open the straw for dispensing when opening the valve to the can.

What is claimed is:

1. An article (10) comprising a can (20) and a dispenser (30), wherein:

(a) the can has a valve (40) that includes a valve cup (42) surrounding a stationary valve stem housing (44) in which a depressible valve stem (46) resides and which extends out from or is accessible through a top side (48) of the stationary valve stem housing; and (b) the dispenser comprises;

(i) a base (50) that has a side (52), a bottom (54) and a top (55) with an entrance opening (56) to a flow channel (58) defined through the bottom and extending through the base and out the top, wherein the base fits into the valve cup of the can with the stationary valve stem housing inserted into the entrance opening of the base when attached to the valve of the can;

(ii) a straw (60) having a straw wall (62) separating an entrance end (64) and an exit (66) end by a length (L) where the straw wall defines a straw flow channel (68) that extends from an entrance opening (65) defined through the straw proximate to the entrance end through an exit opening (67) defined through the straw proximate to the exit end and where the straw is attached proximate to the straw's entrance end to the base proximate to the top of the base such that there is fluid communication from the flow channel of the base through the entrance opening and into the flow channel of the straw where the base flow channel and the straw flow channel form a continuous dispenser flow channel extending through the entrance opening of the base through the dispenser and out through the exit opening of the straw;

(iii) a sleeve (70) extending over at least a portion of the length of the straw and that is able to slide over the straw along at least a portion of the length of the straw, the sleeve having an exit opening (72) extending through the sleeve proximate to the exit end of the straw;

(iv) a trigger (80) hingedly attached to the base and/or straw of the dispenser at a hinge point (82) so that the trigger can move without moving the straw or base and having a sleeve engagement portion (84) of the trigger that engages the sleeve above the hinge point and a trigger arm (86) extending below the hinge point; and (v) a plunger (90) extending from the trigger arm of the trigger, through a side of the base and into the flow channel of the base while maintaining fluid communication through and/or around the plunger within the flow channel of the dispenser;

wherein, the dispenser is attachable to the valve of the can by inserting the stationary valve stem housing into the entrance opening of the flow channel of the dispenser base while inserting the dispenser base into the valve cup of the valve; and wherein, the plunger extends into the dispenser flow channel far enough so that when the dispenser is attached to the valve of the can the depressible valve stem is in a closed position that seals the can valve while the trigger arm is in a closed position, and displacing the trigger arm from the closed position to an open position causes the sleeve to slide along the straw away from the entrance opening of the straw and causes the plunger to depress the depressible valve stem into an open position.

2. The article of claim 1, wherein: (a) an outer surface of the base wall and an inner surface of the valve cup have threading (100) that mate in a threaded manner; or (b) an inner surface of the entrance opening and/or flow channel of the base and an outer surface of the stationary valve stem housing have threading (105) that mate in a threaded manner; or (c) both the outer surface of the base wall and the inner surface of the valve cup have threading that mate in a threaded manner and the inner surface of the entrance opening and/or flow channel of the base and the outer surface of the stationary valve stem housing have threading that mate in a threaded manner.

3. The article of any one previous claim, wherein the plunger is unattached to the trigger arm.

4. The article of any one previous claim, wherein an elastic article (110) resides between the trigger arm and the base and/or straw of the dispenser that applies a restoring force directing the trigger arm towards the trigger arm's neutral position when the trigger arm is displaced towards the can.

5. The article of claim 1, wherein the sleeve has a closed position relative to the straw in which the sleeve seals the exit opening of the straw and, when the sleeve moves from the closed position away from the entrance end of the straw, the sleeve unseals the exit opening of the straw causing the sleeve to be in an open position in which there is fluid communication from the straw flow channel through the straw exit opening and through the sleeve exit opening.

6. The article of claim 1, wherein the dispenser further comprises a gasket (74) extending circumferentially around the straw between the straw and the sleeve and located along the length of the straw between the entrance opening and exit opening of the straw.

* * * * *